US007746286B2

(12) United States Patent
Suzuki

(10) Patent No.: US 7,746,286 B2
(45) Date of Patent: Jun. 29, 2010

(54) ANTENNA DEVICE HAVING GOOD SYMMETRY OF DIRECTIONAL CHARACTERISTICS

(75) Inventor: Tomotaka Suzuki, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/943,524

(22) Filed: Nov. 20, 2007

(65) Prior Publication Data

US 2008/0136712 A1 Jun. 12, 2008

(30) Foreign Application Priority Data

Dec. 12, 2006 (JP) ..... 2006-334886

(51) Int. Cl.
*H01Q 19/00* (2006.01)

(52) U.S. Cl. ..... 343/833; 343/846

(58) Field of Classification Search ..... 343/700 MS, 343/702, 725, 815, 817, 846, 833
See application file for complete search history.

(56) References Cited

U.S. PATENT DOCUMENTS

| | | | | |
|---|---|---|---|---|
| 6,091,366 | A * | 7/2000 | Zhang et al. | 343/700 MS |
| 6,844,853 | B2 * | 1/2005 | Tai et al. | 343/700 MS |
| 6,977,616 | B2 * | 12/2005 | Yuanzhu | 343/700 MS |
| 6,985,108 | B2 * | 1/2006 | Mikkola et al. | 343/700 MS |
| 7,026,999 | B2 * | 4/2006 | Umehara et al. | 343/702 |
| 7,050,010 | B2 * | 5/2006 | Wang et al. | 343/702 |
| 7,170,450 | B2 * | 1/2007 | Chang et al. | 343/700 MS |
| 7,319,432 | B2 * | 1/2008 | Andersson | 343/702 |
| 2004/0108957 | A1 | 6/2004 | Umehara et al. | |
| 2005/0110692 | A1 | 5/2005 | Andersson | |

FOREIGN PATENT DOCUMENTS

| | | |
|---|---|---|
| EP | 1 271 690 | 1/2003 |
| EP | 1 359 639 | 11/2003 |
| JP | 2003-273639 | 9/2003 |
| JP | 2004-343285 | 12/2004 |

OTHER PUBLICATIONS

European Search Report from European Application No. 07023677 dated Aug. 26, 2008.

* cited by examiner

*Primary Examiner*—James H. Cho
*Assistant Examiner*—Christopher Lo
(74) *Attorney, Agent, or Firm*—Beyer Law Group LLP

(57) ABSTRACT

An antenna device suitable for short distance wireless communication is provided which can have a good symmetry of directional characteristics and increase a gain at both end sides in a longitudinal direction of a ground pattern. An antenna device is formed by patterning a metal conductor on a printed substrate. The antenna device is provided with a ground pattern of a rectangular shape, a power feed element arranged adjacent to one short side portion of the ground pattern, a correction pattern that projects from the short side portion and is located lateral to the power feed element, and a parasitic radiation element extending along the short side portion at a separation position facing the short side portion of the ground pattern through the power feed element and the correction pattern. An electrical length of the parasitic radiation element is set to be approximately ½ of a resonant length. When power is feed, the power feed element is excited to radiate electric waves.

12 Claims, 5 Drawing Sheets

ANTENNA DEVICE HAVING GOOD SYMMETRY OF DIRECTIONAL CHARACTERISTICS

CLAIM OF PRIORITY

This application claims benefit of the Japanese Patent Application No. 2006-334886 filed on Dec. 12, 2006, which is hereby incorporated by reference.

BACKGROUND OF THE INVENTION

1. Field of the Invention

The present invention relates to an antenna device in which a ground pattern and a pattern antenna are parallel arranged on a printed substrate, and more particularly to an antenna device in which a pattern antenna is arranged in the vicinity of a short side portion of a ground pattern of an approximately rectangular shape.

2. Description of the Related Art

In recent years, short distance wireless technologies of Bluetooth (trademark) and the like have been commercialized to perform wireless data communication between a plurality of electronic devices at home and the like. For example, when an image captured by a digital camera is downloaded to a personal computer (so-called PC) or printed by a printer if these short distance wireless technologies are adopted, the digital camera does not need to be connected to an opposite electronic device through a cable since desired image data can be transmitted from an antenna device embedded in the digital camera to an opposite PC or printer. For example, in a state in which a portable music player is put in a satchel, a bag, or the like when outside if these short distance wireless technologies are adopted, a remote operation of the player may be performed through an antenna device embedded in a terminal controller of a headphone and simultaneously a music reproduced by the player can be listened to through the headphone.

As the antenna device to be used in this short distance wireless communication as described above, a structure capable of being cost-effectively produced in a compact size is preferable. As an antenna device capable of satisfying these requirements, there is a well-known structure in which a ground pattern and a pattern antenna of a predetermined shape are conventionally formed by a metal foil or the like on a printed substrate. The pattern antenna is arranged adjacent to one side end portion of the ground pattern, and operates as, for example, an inverse F type antenna when a power feed signal is supplied to a feed point (for example, see JP-A-2004-343285 (Pages 3 and 4, FIG. 1)).

However, in the conventional antenna device in which the ground pattern and the pattern antenna are parallel arranged on the printed substrate as described above, a radiation element configures the pattern antenna, arranged in the vicinity of the one side end portion of the ground pattern, to which the power feed signal is supplied. However, when the pattern antenna is adjacent to the short side portion of the approximately rectangular shape of the ground pattern, an antenna gain is lowered at both end sides in a longitudinal direction of the ground pattern. This is because a high-frequency current easily flows into the ground pattern in the longitudinal direction when the pattern antenna is powered on and excited. If a casing for containing the printed substrate has an elongate shape, the ground pattern is mostly formed in an approximately rectangular shape.

However, the antenna device in which the casing has the elongate shape and the gain is low at both the end sides in the longitudinal direction of the ground pattern is not necessarily convenient for use. That is, when users holding the casing of the elongate shape perform short distance wireless communication (data communication) with an opposite electronic device, many users cause one end side in the longitudinal direction of the casing to be toward the opposite device. Accordingly, when the antenna gain is low in this direction, communication error may easily occur. For example, in the case of a conventional general antenna device in which a ground pattern 2 of a smaller rectangular shape and an inverse F type pattern antenna 3 adjacent to a short side portion of the ground pattern 2 are arranged on a printed substrate 1 of a rectangular shape and electric waves are radiated from the pattern antenna 3 by supplying a power feed signal to a power feed portion 3*a* as shown in FIG. 9, directional characteristics within a flat surface along the printed substrate 1 are formed as shown in FIG. 10. In FIG. 10, an azimuth angle of 0 degree is present in a side of the ground pattern 2 as viewed from the pattern antenna 3. That is, it can be seen that a straight-line direction connecting azimuth angles of 0 and −180 degrees corresponds to the longitudinal direction of the ground pattern 2 and a sufficient gain is not obtained in this direction.

As is apparent from a dip of the directional characteristics shown in FIG. 10, a gain of the antenna device shown in FIG. 9 is extremely lowered in a specific direction (at the azimuth angle of 120 or −90 degrees). Accordingly, there is a problem in that it is difficult to practically realize an omnidirectional antenna device available in any direction. For this reason, for example, there is a worry that a music being listened to is interrupted in mid course when the antenna device is in a specific direction in a headphone or the like in which the music is listened to through the antenna device.

SUMMARY

The present invention has been made in view of the above-mentioned circumstance in the prior art, and an object of the invention is to provide an antenna device suitable for short distance wireless communication that can have a good symmetry of directional characteristics and increase a gain at both end sides in a longitudinal direction of a ground pattern.

To accomplish the above-described object of the present invention, there is provided an antenna device formed by patterning a metal conductor on a printed substrate, including: a ground pattern of an approximately rectangular shape; a power feed element that has a power feed point to which a power feed signal is supplied and is arranged adjacent to one short side portion of the ground pattern; a correction pattern that projects from the short side portion of the ground pattern and is located lateral to the power feed element; and a parasitic radiation element that extends along the short side portion and is arranged at a separation position facing the short side portion of the ground pattern through the power feed element and the correction pattern, wherein an electrical length of the parasitic radiation element is set to be approximately ½ of a resonant length and the parasitic radiation element is configured to excite the power feed element when feeding power.

In the antenna device configured as described above, it is difficult for a high-frequency current flowing in a longitudinal direction to occur in the ground pattern since the power feed element and the correction pattern are parallel arranged in an area between the ground pattern and the parasitic radiation element and power is not directly fed to the parasitic radiation element but is fed to the parasitic radiation element through the power feed element. Since the parasitic radiation element excited by the power feed element operates as a dipole antenna, it is easy to make directional characteristics similar to those of the dipole antenna. Since not only one side in the extension direction of the parasitic radiation element can be electromagnetically coupled to the power feed element, but also the correction pattern serving as the projection portion of the ground pattern can be electromagnetically coupled to the other side in the extension direction of the parasitic radiation element, the directional characteristics of electric waves radiated from the parasitic radiation element can be easily set to be approximately symmetrical with respect to a straight line for bisecting the parasitic radiation element through an intermediate between the power feed element and the correction pattern. Therefore, an antenna device can be easily realized which can have a good symmetry of directional characteristics and increase a gain at both end sides in a longitudinal direction of a ground pattern.

In the above-described configuration, the parasitic radiation element operating as the dipole antenna also radiates the electric waves to spaces at both the end sides in the extension direction when the capacity is loaded between the projection portion and the ground pattern by causing both end portions in the extension direction of the parasitic radiation element to project to the short side portion of the ground pattern. For this reason, the effect of extremely lowering a gain in a specific direction is difficult to occur. An omnidirectional antenna device available in any direction can be practically easily realized. Moreover, when a C component (capacitance) increases in an area where a voltage of the parasitic radiation element increases, the parasitic radiation element can be miniaturized and therefore the miniaturization of the overall antenna device can be easily promoted.

In the above-described configuration, the miniaturization of the overall antenna device can be easily promoted by shortening the total length of the parasitic radiation element since an L component (inductance) increases in an area where a current of the parasitic radiation element increases when the parasitic radiation element is patterned in a shape in which the approximately center portion has a narrow width in the extension direction of the parasitic radiation element.

In the above-described configuration, preferably, the parasitic radiation element is easily excited when the power feed element is an inverse L type or a loop type.

In the above-described configuration, preferably, the symmetry of directional characteristics is better when the correction pattern is formed in an outer shape approximately equal to that of the power feed element.

In an antenna device of the present invention, it is difficult for a high-frequency current flowing in a longitudinal direction to occur in a ground pattern when feeding power and a parasitic radiation element excited by a power feed element can operate as a dipole antenna, and the symmetry of directional characteristics is easily ensured by a correction pattern. Therefore, a gain can increase at both end sides in the longitudinal direction of the ground pattern of an approximately rectangular shape and an antenna device suitable for short distance wireless communication can be easily realized.

DESCRIPTION OF THE EMBODIMENTS

Figure 1:
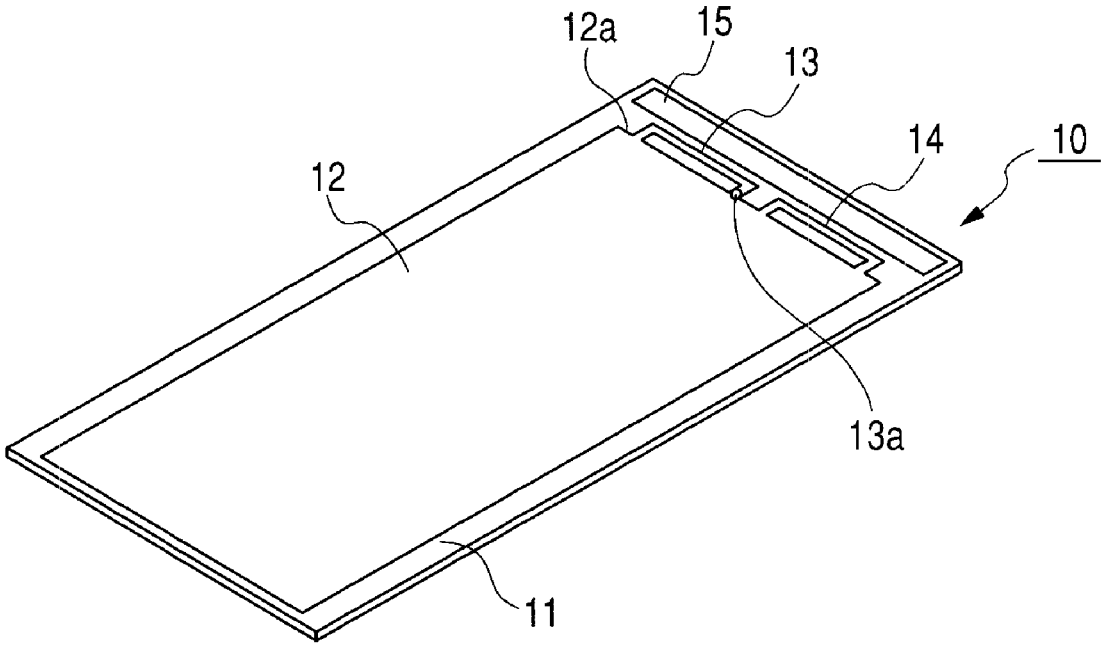
FIG. 1 is a perspective view of an antenna device according to a first embodiment of the present invention.

Embodiments of the invention will be described with reference to the drawings. FIG. 1 is a perspective view of an antenna device according to a first embodiment of the present invention, FIG. 2 is a plan view of main parts of the antenna device shown in FIG. 1, and FIG. 3 is a characteristic view showing directivity of the antenna device shown in FIG. 1.

Figure 2:
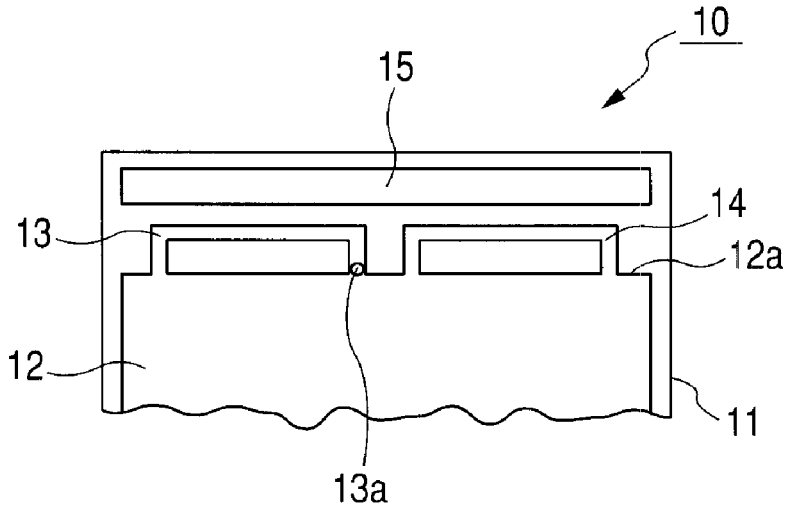
FIG. 2 is a plan view of main parts of the antenna device shown in FIG. 1.
Figure 3:
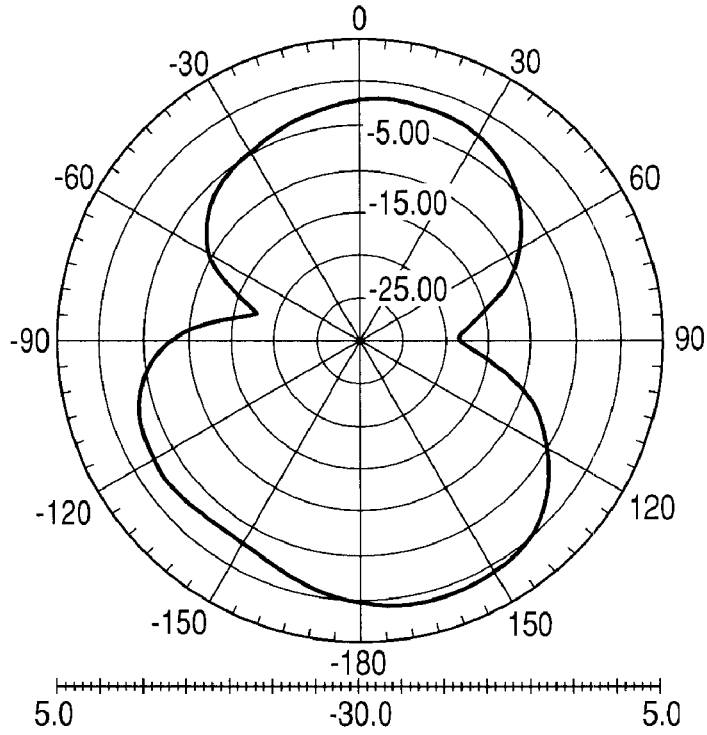
FIG. 3 is a characteristic view showing directivity of the antenna device shown in FIG. 1.

As shown in FIGS. 1 and 2, an antenna device 10 is formed by patterning a metal conductor such as a metal foil or the like on a printed substrate 11 of a rectangular shape. The antenna device 10 is provided with a ground pattern 12 of a rectangular shape smaller than that of the printed substrate 11, a power feed element 13 arranged adjacent to one short side portion 12*a* of the ground pattern 12, a correction pattern 14 which projects from the short side portion 12*a* of the ground pattern 12 and is located lateral to the power feed element 13, and a parasitic radiation element 15 that extends along the short side portion 12*a* and is arranged at a separation position facing the short side portion 12*a* of the ground pattern 12 through the power feed element 13 and the correction pattern 14. Although not shown, a transmitting and receiving circuit or various electronic components are installed in the printed substrate 11 and a power feed line drawn from the transmitting and receiving circuit is connected to a power feed point 13*a* of the power feed element 13. FIG. 3 shows directional characteristics of the antenna device 10 within a flat surface along the printed substrate 11. In FIG. 3, an azimuth angle of 0 degree is present in a side of the ground pattern 12 as viewed from the parasitic radiation element 15. A straight-line direction connecting azimuth angles of 0 and −180 degrees corresponds to the longitudinal direction of the ground pattern 12.

The power feed element 13 is patterned as a strip-shaped conductor extending along three sides of the rectangular shape. One end portion of the power feed element 13 has the power feed point 13*a* and the other end portion is connected to the short side portion 12*a* of the ground pattern 12. The correction pattern 14 is patterned as a strip-shaped conductor whose shape is approximately equal to that of the power feed element 13, but both end portions of the correction pattern 14 are connected to the short side portion 12*a* of the ground pattern 12.

The parasitic radiation element 15 is adjacent to the power feed element 13 or the correction pattern 14 at a predetermined distance therefrom, and simultaneously extends in a straight-line shape along the short side portion 12*a* of the ground pattern 12. An electrical length of the parasitic radiation element 15 is set to be approximately ½ of a resonant length. When power is fed, the power feed element 13 is excited to radiate electric waves. That is, when a power feed signal is supplied and the power feed element 13 is excited, the parasitic radiation element 15 is excited and operated as a dipole antenna since one side in the extension direction of the parasitic radiation element 15 is electromagnetically coupled to the power feed element 13 and simultaneously the other side in the extension direction of the parasitic radiation element 15 is electromagnetically coupled to the correction pattern 14.

In the antenna device 10 configured as described above, it is difficult for a high-frequency current flowing in a longitudinal direction to occur in the ground pattern 12 since the power feed element 13 and the correction pattern 14 are parallel arranged in an approximately symmetrical form in an area between the ground pattern 12 and the parasitic radiation element 15 and power is not directly fed to the parasitic radiation element 15 but is fed to the parasitic radiation element 15 through the power feed element 13. Since the parasitic radiation element 15 excited by the power feed element 13 operates as the dipole antenna, its directional characteristics are similar to those of the dipole antenna. Since one side in the extension direction of the parasitic radiation element 15 is electromagnetically coupled to the power feed element 13, the other side is electromagnetically coupled to the correction pattern 14, and the correction pattern 14 is formed in an outer shape approximately equal to that of the power feed element 13, the directional characteristics of electric waves radiated from the parasitic radiation element 15 are approximately symmetrical with respect to a straight line for bisecting the parasitic radiation element 15 through an intermediate between the power feed element 13 and the correction pattern 14. As shown in FIG. 3, the symmetry of directional characteristics of the antenna device 10 is good and the gain specifically increases at both the end sides in the longitudinal direction of the ground pattern 12. Therefore, the antenna device 10 is suitable to be used for short distance wireless communication.

Figure 4:
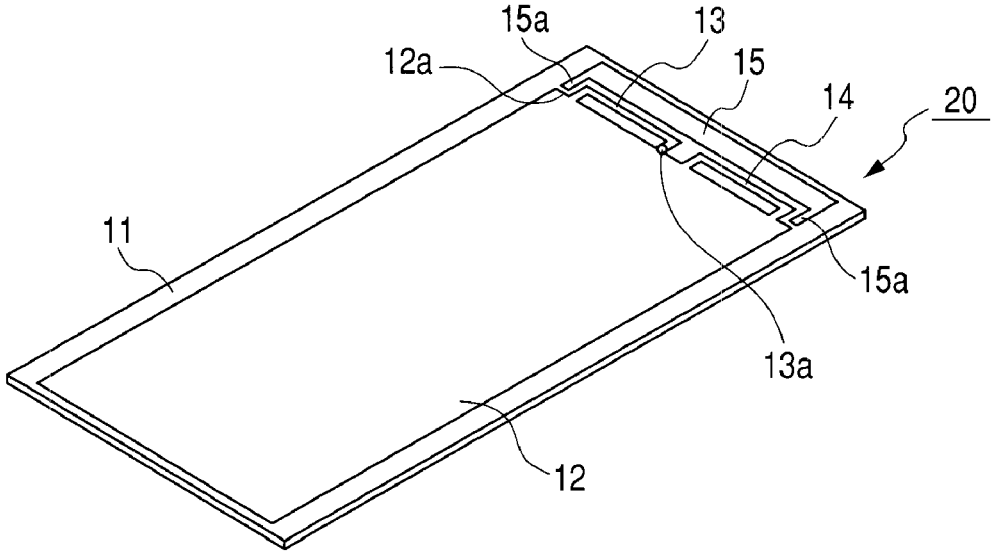
FIG. 4 is a perspective view of an antenna device according to a second embodiment of the present invention.
Figure 5:
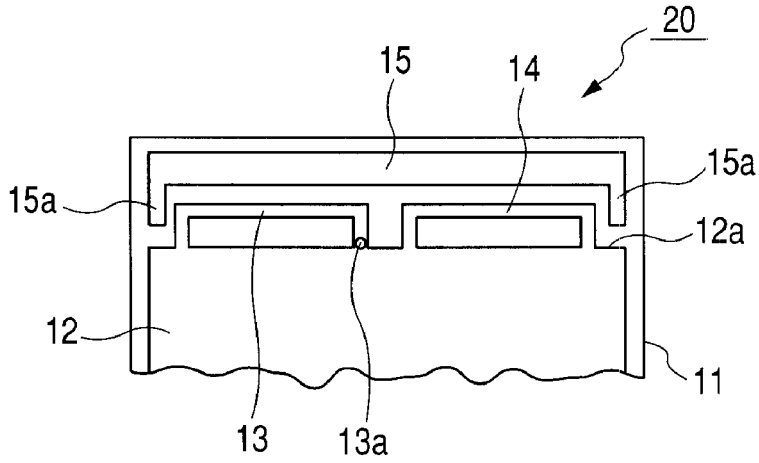
FIG. 5 is a plan view of main parts of the antenna device shown in FIG. 4.
Figure 6:
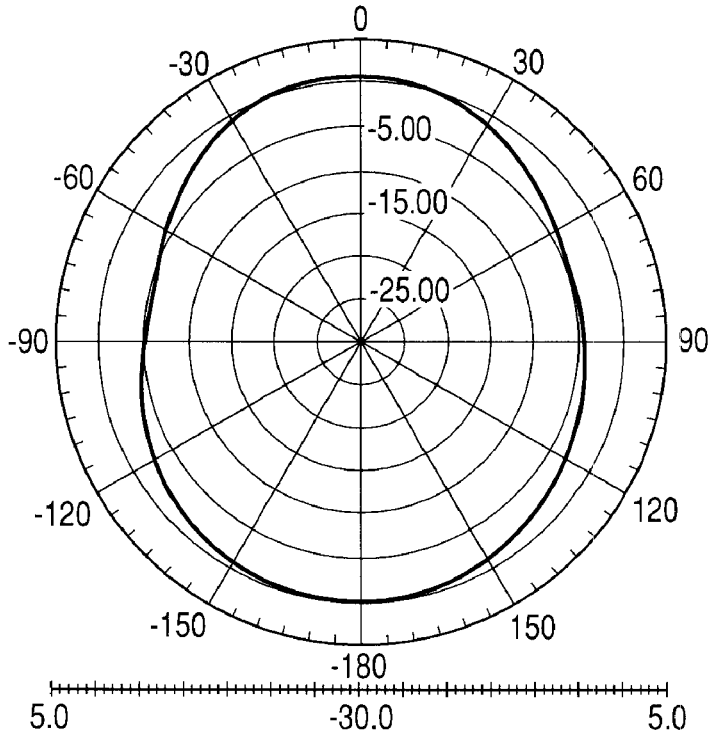
FIG. 6 is a characteristic view showing directivity of the antenna device shown in FIG. 4.

FIG. 4 is a perspective view of an antenna device according to a second embodiment of the present invention, FIG. 5 is a plan view of main parts of the antenna device, and FIG. 6 is a characteristic view showing directivity of the antenna device shown in FIG. 4. Since parts corresponding to those of FIGS. 1 and 2 are assigned the same reference numerals, a repeated description is omitted.

In an antenna device 20 shown in FIGS. 4 and 5, a shape of a parasitic radiation element 15 is different from that of the above-described first embodiment (of the antenna device 10). That is, in the antenna device 20 according to this embodiment, a sub radiation portion 15*a* projecting to a short side portion 12*a* of a ground pattern 12 is arranged at both end portions in an extension direction of the parasitic radiation element 15, such that a capacity is loaded between the sub radiation element 15*a* and the ground pattern 12. Accordingly, the parasitic radiation element 15 operating as a dipole antenna also radiates electric waves to spaces at both end sides in the extension direction. As shown in FIG. 6, directional characteristics in which a dip is small can be obtained. FIG. 6 shows directional characteristics of the antenna device 20 within a flat surface along a printed substrate 11. In FIG. 6, an azimuth angle of 0 degree is present in a side of the ground pattern 12 as viewed from the parasitic radiation element 15. A straight-line direction connecting azimuth angles of 0 and −180 degrees corresponds to the longitudinal direction of the ground pattern 12.

In the second embodiment as described above, the antenna device 20 can be used in any direction and can be distinctly suitable for short distance wireless communication since the effect of extremely lowering a gain in a specific direction does not occur and omnidirectivity can be practically realized. Moreover, the parasitic radiation element 15 in which the sub radiation portion 15*a* is arranged at both the end portions in the extension direction can be miniaturized since a C component (capacitance) increases in an area where a voltage increases. Therefore, the miniaturization of the overall antenna device 20 can be easily promoted.

Figure 7:
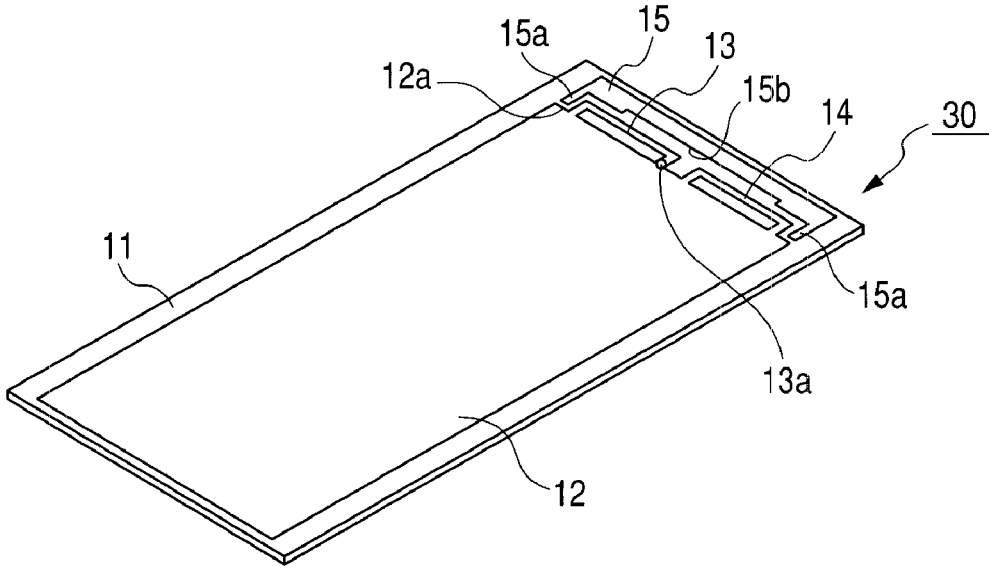
FIG. 7 is a perspective view of an antenna device according to a third embodiment of the present invention.

FIG. 7 is a perspective view of an antenna device according to a third embodiment of the present invention. Since parts corresponding to those of FIG. 4 are assigned the same reference numerals, a repeated description is omitted.

An antenna device 30 shown in FIG. 7 is different from the second embodiment (of the antenna device 20) as described above in that a center portion in an extension direction of a parasitic radiation element 15 and its neighborhood have a slightly narrow width by providing a notch portion 15*b* in the parasitic radiation element 15. Accordingly, the miniaturization of the parasitic radiation element 15 can be promoted since an L component (inductance) increases in an area where a current increases. Therefore, the further miniaturization of the antenna device 30 can be easily promoted.

Figure 8:
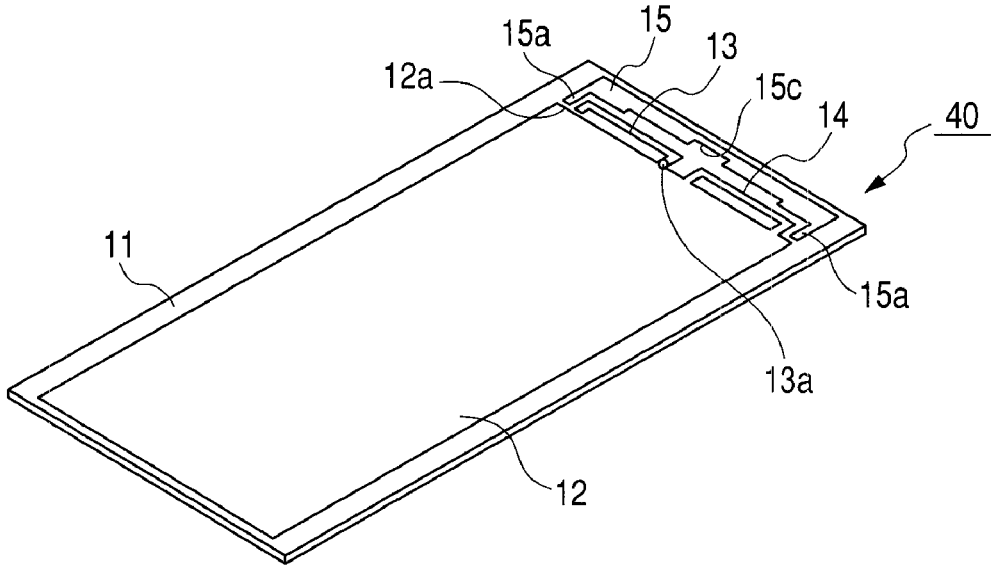
FIG. 8 is a perspective view of an antenna device according to a fourth embodiment of the present invention.
Figure 9:
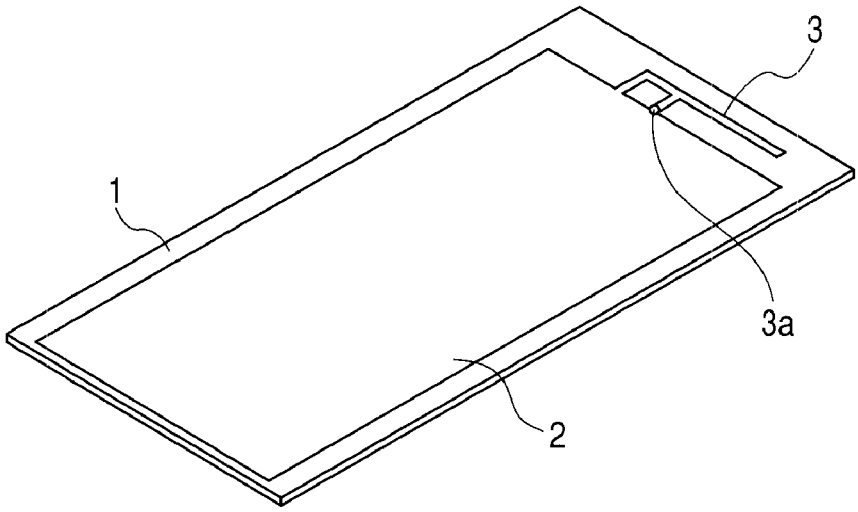
FIG. 9 PRIOR ART
FIG. 9 is a perspective view of an antenna device according to a conventional example.
Figure 10:
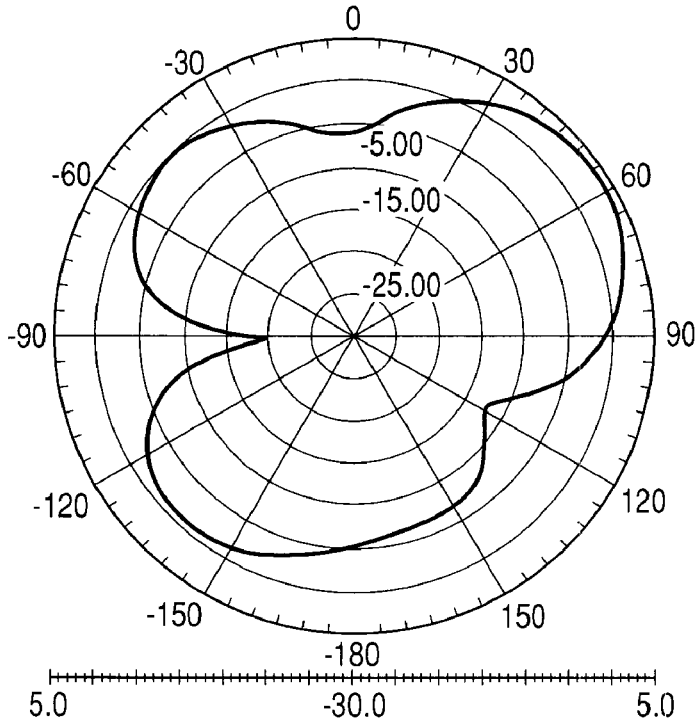
FIG. 10 PRIOR ART
FIG. 10 is a characteristic view showing directivity of the antenna device shown in FIG. 9.

FIG. 8 is a perspective view of an antenna device according to a fourth embodiment of the present invention. Since parts corresponding to those of FIG. 7 are assigned the same reference numerals, a repeated description is omitted.

In a parasitic radiation element 15 of an antenna device 40 shown in FIG. 8, a center portion in an extension direction has a specifically narrow width and also a neighborhood of the center portion has a slightly narrow width since there is provided a notch portion 15*c* locally deeper than the notch portion 15*b* of the third embodiment (of the antenna device 30) as described above. Accordingly, since the further miniaturization of the parasitic radiation element 15 can be promoted, the antenna device 40 can be easily miniaturized. In the antenna device 40, an end portion of a side separated from a power feed point 13*a* of a power feed element 13 is not connected to a ground pattern 12, and operates as an inverse L type power feed element 13. In this regard, the directional characteristics of electric waves radiated from the parasitic radiation element 15 are almost identical even when the power feed element 13 is the inverse L type and the loop type.

The invention claimed is:

1. An antenna device formed by patterning a metal conductor on a printed substrate, comprising:

a ground pattern of an approximately rectangular shape having two short sides and two long sides;

a parasitic radiation element extending along an extension direction substantially in parallel with a first short side of the ground pattern, the parasitic radiation element being provided at a certain distance apart from the first short side of the ground pattern so as to provide a space between the parasitic radiation element and the first short side of the ground pattern;

a power feed element provided in the space between the parasitic radiation element and the ground pattern, the power feed element having a power feed point to which a power feed signal is supplied; and a correction pattern provided in the space between the parasitic radiation element and the ground pattern, the correction pattern projecting from the first short side of the ground pattern and is located lateral to the power feed element, wherein an electrical length of the parasitic radiation element is set to be approximately ½ of a resonant length.

2. The antenna device according to claim 1, wherein the parasitic radiation element comprises:

a sub radiation portion located at each end thereof in the extension direction, wherein the sub radiation portion projects from the end towards the first short side of the ground pattern, such that a capacity is loaded between the sub radiation portion and the ground pattern.

3. The antenna device according to claim 1, wherein the parasitic radiation element has a center portion in the extension direction with a narrow width.

4. The antenna device according to claim 1, wherein the power feed element is an inverse L type or a loop type.

5. The antenna device according to claim 1, wherein the correction pattern has an outer shape approximately same as that of the power feed element.

6. The antenna device according to claim 1, wherein the ground pattern, the power feed element, the correction pattern and the parasitic radiation element are arranged substantially in the same plane.

7. The antenna device according to claim 1, wherein the correction pattern has two ends and wherein both of the two ends of the correction pattern are coupled with the first short side of the ground pattern.

8. The antenna device according to claim 1, wherein the power feed element has two ends and wherein one of the two ends of the power feed element is coupled with the first short side of the ground pattern.

9. The antenna device according to claim 1, wherein the parasitic radiation element is excited by the power feed element when the power feed signal is supplied to the power feed element.

10. The antenna device according to claim 9, wherein the parasitic radiation element operates as a dipole antenna in response to being excited by the power feed element.

11. The antenna device according to claim 1, wherein the power feed element and the correction pattern have a substantially same outer shape and are substantially symmetrical each other with respect to a line drawn between the power feed element and the correction pattern in a longitudinal direction along the long sides of the ground pattern.

12. The antenna device according to claim 11, wherein the line between the power feed element and the correction pattern substantially bisects the parasitic radiation element.

* * * * *